US005821681A

United States Patent [19]

Wynn

[11] Patent Number: 5,821,681

[45] Date of Patent: Oct. 13, 1998

[54] LOW PRESSURE DISCHARGE LAMP ASSEMBLY

[75] Inventor: William H. Wynn, Hillsborough, Calif.

[73] Assignee: Wedgewood Technology, Inc., San Carlos

[21] Appl. No.: 536,325

[22] Filed: Sep. 29, 1995

[51] Int. Cl.[6] ..... H01J 17/18; H01J 61/36

[52] U.S. Cl. ..... 313/318.01; 313/318.05; 313/318.08; 313/318.09; 313/318.11; 313/113; 313/623; 313/312; 362/296; 362/310; 362/221; 362/341; 315/326

[58] Field of Search ..... 313/318.01, 318.05, 313/318.08, 318.11, 113, 484, 572, 623, 626, 634, 242, 312, 318.09; 439/602, 605, 614, 611; 362/296, 310, 221, 341, 343, 307; 315/56, 339, 326

[56] References Cited

U.S. PATENT DOCUMENTS

| | | | |
|---|---|---|---|
| 2,548,353 | 4/1951 | Cunningham | 313/312 X |
| 3,808,495 | 4/1974 | Win | 313/312 X |
| 4,358,708 | 11/1982 | Silva et al. | 313/318.01 X |
| 4,866,341 | 9/1989 | Ichiga et al. | 313/318.01 X |
| 4,868,450 | 9/1989 | Colterjohn, Jr. | 313/113 X |
| 4,878,854 | 11/1989 | Cannon | 313/318.05 X |
| 5,506,763 | 4/1996 | Carley | 313/113 X |
| 5,634,820 | 6/1997 | Vakil | 313/318.01 X |

FOREIGN PATENT DOCUMENTS

| | | | |
|---|---|---|---|
| 1958896 | 6/1971 | Germany | 313/113 |

*Primary Examiner*—Ashok Patel
*Attorney, Agent, or Firm*—Flehr Hohbach Test Albritton & Herbert LLP

[57] ABSTRACT

Low voltage discharge lamp assembly which has a plug-in base and, in some embodiments, includes a power supply as an integral part of the assembly. The electrode leads pass through a base cap to form contact pins for engagement with a socket. By controlling the orientation of the pins relative to the electrodes and discharge path within the lamp, the lamp is easily removed and replaced without disturbing the direction and focusing of the light it produces.

9 Claims, 2 Drawing Sheets

LOW PRESSURE DISCHARGE LAMP ASSEMBLY

BACKGROUND OF THE INVENTION

1. Field of the Invention

This invention pertains generally to low pressure discharge lamps and, more particularly, to a low pressure discharge lamp assembly which includes a power supply as an integral part of the assembly.

2. Related Art

Low pressure discharge lamps such as mercury vapor lamps are well known and widely used as a source of ultra violet radiation for industrial applications such as light sources for calibration instruments, optical measurement instruments, and the like.

A typical low pressure discharge lamp of the type heretofore provided is illustrated in FIG. 1. The envelope of the lamp consists of an elongated bulb 11 with a necked-down stem 12 of reduced diameter at rear of the bulb. Electrode leads 13 extend from the stem. Those leads are typically a refractory metal such as molybdenum. Since molybdenum is non-solderable, lugs 14 fabricated of a wettable metal such as nickel are spot-welded to the molybdenum leads, and a high voltage cable 16 is soldered to the nickel lugs. That cable is used for connecting the lamp to a remotely located power supply, and typically has a length on the order of 24 to 36 inches.

A sleeve 17 (sometimes referred to in the lamp industry as a "handle") is mounted over the rear portion of the bulb and extends rearwardly from the bulb for a distance approximately as long as the bulb itself. The sleeve is cemented to the bulb, and the region within the sleeve is filled with epoxy 18 to form a solid mass from which the high voltage leads extend.

This structure has certain limitations and disadvantages. The spot-welding of the nickel lugs and soldering of the high voltage leads is a multi-step process which is not only time consuming, but also results in the loss of a substantial number of lamps during manufacture due to excessive handling and breakage. That, of course, increases the cost of the lamps.

The applications in which the lamps can be used are limited by the length of the sleeve, and whenever a lamp is replaced, it must be adjusted for proper direction and focusing of the light from it.

OBJECTS AND SUMMARY OF THE INVENTION

It is in general an object of the invention to provide a new and improved low pressure discharge lamp assembly.

Another object of the invention is to provide a lamp assembly of the above character which overcomes the limitations and disadvantages of the prior art.

These and other objects are achieved in accordance with the invention by providing low voltage discharge lamp assembly which has a plug-in base and, in some embodiments, includes a power supply as an integral part of the assembly. The electrode leads pass through a base cap to form contact pins for engagement with a socket. By controlling the orientation of the pins relative to the electrodes and discharge path within the lamp, the lamp is easily removed and replaced without disturbing the direction and focusing of the light it produces.

BRIEF DESCRIPTION OF THE DRAWINGS

FIG. 3 is side elevational view, partly in section, of the lamp assembly of

FIG. 2 with a mounting socket.

DETAILED DESCRIPTION

Figure 1:
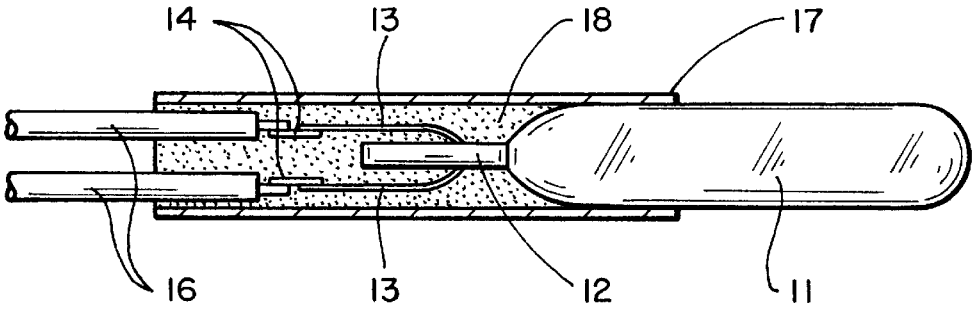
FIG 1 (PRIOR ART)
FIG. 1 is a longitudinal sectional view of one embodiment of a prior art device.
Figure 2:
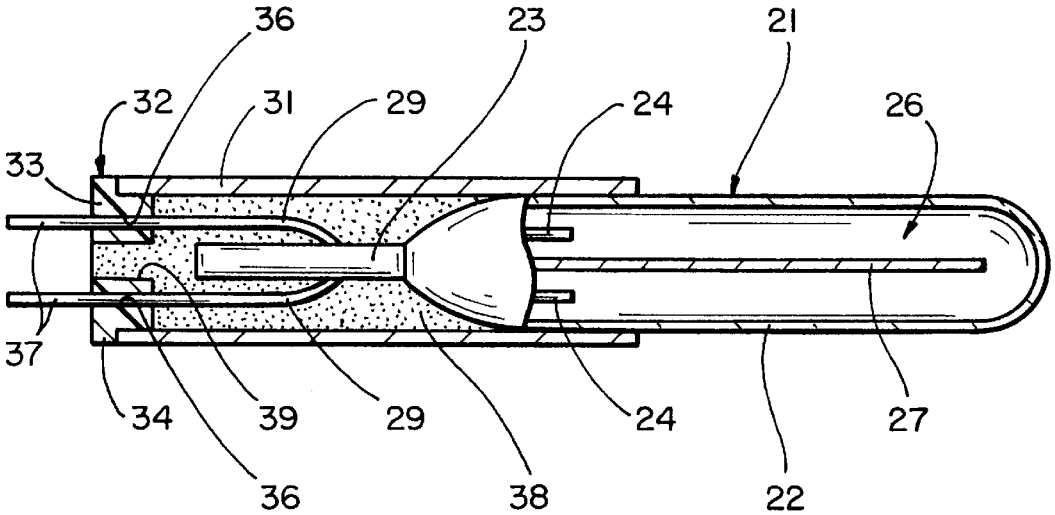
FIG. 2 is a longitudinal sectional view, partly broken away, of one embodiment of a lamp assembly incorporating the invention.

As illustrated in FIG. 2, the lamp assembly includes an elongated tubular envelope 21 similar to the envelopes employed in the prior art devices. This envelope has an elongated bulb 22 with a necked-down stem 23 of reduced diameter at the rear of the bulb. It is fabricated of a transparent material such as fused silica or quartz. As in the prior art devices, the envelope contains an ionizable gas such as argon with a small amount of mercury and electrodes 24 for energization of the gas. The interior of the bulb is divided into a U-shaped channel 26 by a longitudinally extending baffle 27 which terminates a short distance before the front, or outer, end of the bulb. The electrodes are positioned toward the rear of the bulb on opposite sides of the baffle. The glow produced by the gas discharge follows the U-shaped channel, and the light produced by the lamp is strongest in a direction perpendicular to the plane of the electrodes.

Leads 29 are bonded to the electrodes within the sealed enclosure. Those leads are fabricated of a heavier gauge of molybdenum wire (e.g., 0.025) than the leads in the prior art devices so that they will be relatively rigid and suitable to serve as connecting pins for the lamp.

A cylindrical sleeve 31 is mounted on the rear portion of the lamp bulb, as in the prior art devices. However, this sleeve is shorter in length than the prior sleeves and extends only a short distance (e.g., ¼ inch) to the rear of the envelope. An end cap 32 is provided at the rear of the sleeve. The end cap has a circular body 33 which fits inside the sleeve and a flange 34 which abuts against the end of the sleeve to form a base for the lamp.

Electrode leads 29 extend rearwardly from the lamp and pass through openings 36 in the end cap. The leads project a short distance (e.g., 0.20 to 0.50 inch) beyond the end cap to form pins 37 for connecting the lamp to a socket. The pins are spaced apart by a distance on the order of 0.200 inch and oriented in the same plane as the electrodes within the lamp. As discussed further below, this provides a convenient reference for alignment and positioning of the lamp.

The interior of the sleeve, i.e. the region bounded by the sleeve, the envelope and the end cap, is filled with an encapsulating material 38 such as epoxy or cement. A presently preferred material for this purpose is Sauereisen Electrotemp cement (#8 powder) which hardens like a refractory material.

In a presently preferred method of manufacture, the sleeve is placed on the lamp and cemented to the bulb, with the electrode leads extending straight back from the lamp. The end cap is then slid over the leads and positioned against the rear end of the sleeve. The encapsulating material is introduced in liquid form through an opening 39 in the end cap and allowed to harden or cure into a solid mass.

The assembly is substantially more compact than the lamps of the prior art. In one embodiment the sleeve has a length of 1.375 inches and an outer diameter of 0.430 inch, and the overall length of the assembly from the tip of the bulb to the back of the end cap or base is just 2.375 inches. A prior art lamp of comparable wattage typically both somewhat larger in diameter and has a length of about 3.2 to 3.7 inches from the tip of the bulb to the back of the sleeve.

Figure 3:
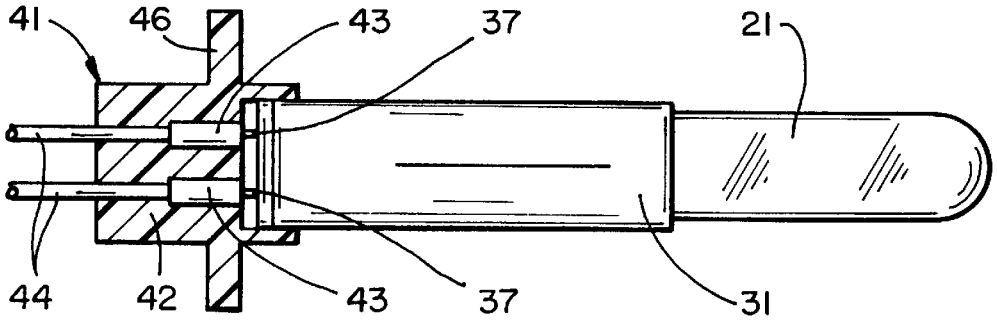

In FIG. 3, the lamp assembly is shown in connection with a socket 41 which has a body 42 with contacts 43 embedded therein for receiving the pins from the lamp. The body is fabricated of a material such as Teflon which can withstand the temperatures at which the lamp operates. High voltage leads 44 are connected to the contacts and extend from the rear of the socket for connection to a power supply for the lamp.

The socket has a mounting flange 46 for attachment to a suitable support (not shown). The position of the flange is fixed in relation to the contacts, and the direction and focusing of the light produced by the lamp can be adjusted simply by rotating the socket. Once the flange is fixed in position, the lamp can be changed and the light will continue to be properly directed and focused without further rotational adjustment.

Figure 4:
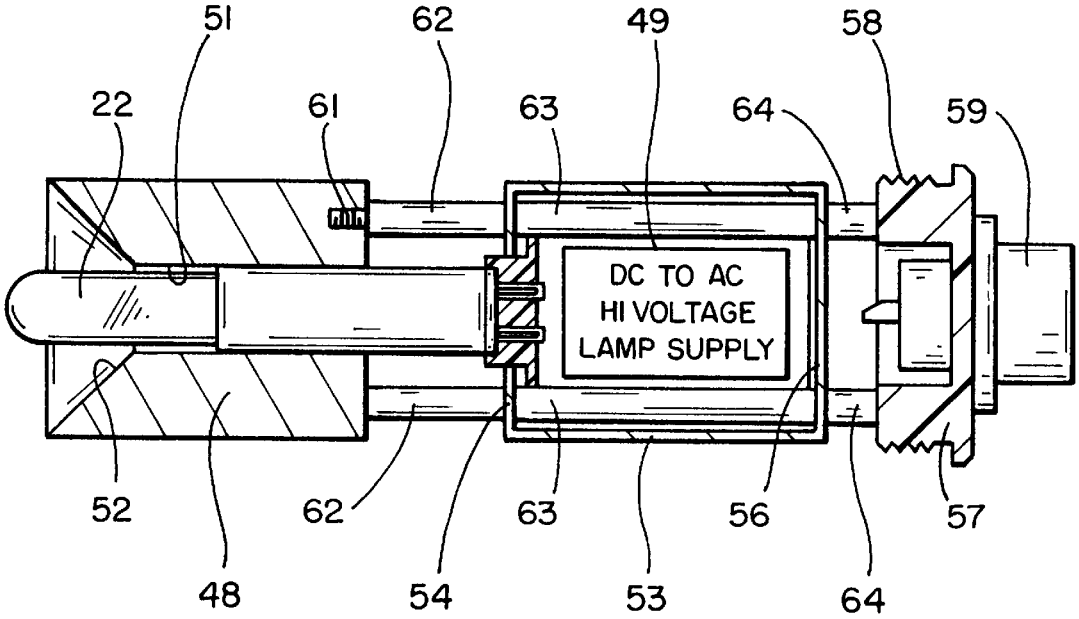
FIG. 4 is side elevational view, partly in section, of the lamp assembly of FIG. 2 with an integral power supply.

The embodiment of FIG. 4 includes a reflector 48 and an integral power supply 49 as part of the lamp assembly. The reflector has a solid cylindrical body with an axial bore 51 through which the bulb extends. The reflector also has a conical reflective surface 52 which diverges outwardly toward the front of the lamp.

The power supply is a current limited supply which is encased in a relatively small cylindrical case. The power supply is disposed within a cylindrical housing 53 which is aligned coaxially of the remainder of the assembly. The housing has a front wall 54 and a rear wall 56, with lamp socket 41 being mounted in the front wall. The power supply operates from a 12 volt source and provides the higher voltages required to operate the lamp. Those voltages include an ignition voltage on the order of 900 to 1,000 volts a.c. and a running voltage on the order of 250 volts at a current on the order of 20 ma.

A mounting flange 57 is provided at the rear of the assembly. In this particular embodiment, the assembly is designed to mount in a threaded opening (not shown), and the mounting flange has a circular body with an external thread 58. The flange is slightly greater in diameter than the reflector and the power supply housing so those elements can pass freely through the opening before the threads are engaged. A connector 59 is mounted on the flange for connection a cable from an external source for the supply. For ease of illustration, the leads which interconnect the power supply with the lamp socket and the source connector are not shown in the drawings, but they are conventional and should be readily apparent to anyone familiar with the art.

The assembly is held together by a pair of elongated screws 61 which extend longitudinally between the mounting flange and the reflector on opposite sides of the assembly. The screws pass through power supply housing 53, with spacers 62–64 on the screws maintaining the spacing between the different elements.

Even with the power supply and reflector, the assembly is still quite compact.

In one embodiment, for example, it has a diameter on the order of 1.25 inches and a length of only about 4.75 inches from the tip of the bulb to the back of the connector.

The invention has a number of important features and advantages. The length of the assembly from the tip of the bulb to the back of the end cap or base is about 25 to 35 percent less than the length of a conventional lamp of comparable size. This permits the assembly to be used in applications where a conventional device will not fit. In addition, the plug-in arrangement makes it easy to replace the lamp, and the orientation of the lamp's discharge area is controlled by the position of the lamp socket. With the socket in a fixed position, a replacement lamp will be oriented and focused in the same direction as the lamp it replaces, and there is no need for rotational alignment of the lamp during routine replacement. With an integral power supply, the assembly is a self-contained, compact unit which can be used in a variety of applications.

It is apparent from the foregoing that a new and improved lamp assembly has been provided. While only certain presently preferred embodiments have been described in detail, as will be apparent to those familiar with the art, certain changes and modifications can be made without departing from the scope of the invention as defined by the following claims.

I claim:

1. In a low pressure discharge lamp assembly: an axially elongated vapor discharge lamp having a pair of electrode leads extending rearwardly from one end thereof, a cylindrical base at the rear of the lamp with the electrode leads extending through the base and a short distance beyond it, a power supply positioned to the rear of the base having a socket in which the electrode leads are received, a reflector mounted on a front portion of the lamp for directing light from the lamp in a forward direction, an endpiece positioned to the rear of the power supply, and fasteners extending between the endpiece and the reflector holding the lamp, power supply and endpiece together.

2. The lamp assembly of claim 1 wherein the power supply has a cylindrical housing which is aligned axially with the lamp, the reflector has a cylindrical outer surface and a conical inner surface which diverges outwardly toward the front of the lamp, and the endpiece is circular in cross-section and of somewhat greater diameter than the power supply housing and the reflector.

3. The lamp assembly of claim 2 wherein the endpiece has an external thread for engagement with a mating thread in an opening in which the assembly is mounted.

4. The lamp assembly of claim 1 including a connector mounted on the endpiece and connected to the power supply for connection to an external source of power.

5. A low pressure vapor discharge lamp assembly adapted to be removably mounted in a socket, comprising: an axially elongated bulb with a necked-down stem of reduced diameter, an ionizable gas within the bulb, a pair of electrodes in the bulb, a pair of electrode leads connected to the electrodes and passing through a side wall of the stem and extending rearwardly from the bulb in an axial direction, and a cylindrical base at the rear of the bulb, the electrode leads extending through the base and a short distance beyond it to form pins for plug-in connection to the socket, there being no other material connected to the leads outside the bulb.

6. The lamp assembly of claim 5 wherein the base comprises a tubular sleeve disposed coaxially about the rear portion of the bulb and the stem, and a cap at the rear end of the sleeve.

7. In a low pressure discharge lamp assembly: an axially elongated bulb with a necked-down stem of reduced diameter, an ionizable gas within the bulb, a pair of electrodes in the bulb, a pair of electrode leads connected to the electrodes and passing through a side wall of the stem and extending rearwardly from the bulb in an axial direction, a cylindrical base at the rear of the bulb, the electrode leads extending through the base and a short distance beyond it, and a power supply positioned to the rear of the base having a socket in which the electrode leads are received in plug-in fashion.

8. The lamp assembly of claim 7 wherein the base comprises a tubular sleeve disposed coaxially about the rear portion of the bulb and the stem, and a cap at the rear end of the sleeve.

9. A self-contained low pressure discharge lamp assembly, comprising: a vapor discharge lamp having an ionizable gas and a pair of electrodes within an envelope, a power supply positioned to the rear of the envelope and in close proximity thereto, and electrically conductive leads extending from the electrodes to the power supply for energization of the electrodes to ionize the gas.

* * * * *